United States Patent [19]

Sagawa

[11] Patent Number: 4,895,602

[45] Date of Patent: Jan. 23, 1990

[54] PIPE CLEANING METHOD

[76] Inventor: Shizuo Sagawa, 12-8, Minami Kugahara 1-chome, Ota-ku, Tokyo, Japan

[21] Appl. No.: 145,303

[22] Filed: Jan. 19, 1988

[30] Foreign Application Priority Data

Aug. 1, 1987 [JP] Japan ..... 62-191525

[51] Int. Cl.[4] ..... B08B 9/02

[52] U.S. Cl. ..... 134/6; 134/7; 134/8

[58] Field of Search ..... 134/6, 9, 8

[56] References Cited

U.S. PATENT DOCUMENTS 3,546,642 12/1970 Fredrick et al. ..... 134/8
3,607,399 9/1971 Hanselmann ..... 134/8
4,244,073 1/1981 Sagawa ..... 134/6

FOREIGN PATENT DOCUMENTS 53-26467 11/1978 Japan ..... 134/7
55-72868 of 1980 Japan .
58-45831 of 1983 Japan .

*Primary Examiner*—Asok Pal
*Attorney, Agent, or Firm*—Finnegan, Henderson, Farabow, Garrett & Dunner

[57] ABSTRACT

A method of cleaning the interior of a pipe includes introducing a group of small spheres into the interior of the pipe, each small sphere having a number of pins driven therein in such a manner that respective heads of the pins are left exposed, applying hydraulic pressure to the group of small spheres from one side thereof, and causing the group of small spheres to flow through the interior of the pipe substantially along a hydromechanic velocity distribution curve. The small spheres form a mass within the pipe and undergo motion in accordance with a velocity distribution curve that conforms to the pipe diameter, thus making it possible to clean the interior of a pipe the diameter of which varies along its length.

2 Claims, 1 Drawing Sheet

PIPE CLEANING METHOD

BACKGROUND OF THE INVENTION

This invention relates to a method of cleaning the inner wall of a pipe.

Scale or slag can deposit on the inner wall of a pipe for supplying water, pertroleum or various types of gases and can eventually reduce the effective cross sectional area of the pipe and thus impede the flow of fluids therethrough. For this reason, the inner wall surface of the pipe is cleaned periodically to remove the scale.

To clean a pipe of the type described, a sweeper (also referred to as a "pig") made of synthetic resin and having a conical portion at its forward end is inserted into the pipe while being elastically deformed, hydraulic pressure is applied to the rearward end of the sweeper within the pipe, and the scale on the inner wall of the pipe is scraped off by the sweeper while the sweeper is advanced through the pipe by a difference in pressure between the forward and rearward ends of the sweeper. The scraping off of the scale is actually performed by the heads of a number of metal pins driven in toward the center of the sweeper from the outer peripheral surface thereof. The heads of these pins advance together with the sweeper while being brought into pressured contact with the inner wall of the pipe and strike the scale to remove the same from the inner wall. The pins are made of a material not as hard as that of the pipe and somewhat harder than that of the scale or slag to be scraped off from the inner wall of the pipe.

Pins of this type and a sweeper equipped with the pins have already been proposed by the inventor in Japanese Patent Publication (KOKOKU) No. 58-36634 and Japanese Utility Model Publication (KOKOKU) No. 58-45831.

The conventional sweeper described above is capable of cleaning a pipe efficiently providing that the diameter of the pipe to be cleaned is constant over the entire length of the pipe. However, the conventional sweeper is not suitable for a pipe having an irregular diameter, namely a pipe whose diameter differs along the length of the pipe. Specifically, at a portion of such a pipe having a larger diameter, the heads of the pins driven into the sweeper will not make good pressured contact with the inner wall of the pipe. At portions where the diameter is small, the sweeper will not be able to pass through the pipe.

SUMMARY OF THE INVENTION

Accordingly, an object of the present invention is to provide a pipe cleaning method which will make it possible to clean the inner wall of a pipe having an irregular diameter along the length of the pipe.

According to the present invention, the foregoing object is attained by providing a method of cleaning the interior of a pipe comprising the steps of introducing a group of small spheres into the interior of the pipe, each small sphere having a number of pins driven therein in such a manner that respective heads of the pins are left exposed, applying hydraulic pressure to the group of small spheres from one side thereof, and causing the group of small spheres to flow through the interior of the pipe substantially along a hydromechanic velocity distribution curve.

The small spheres having the exposed pin heads form a mass within the pipe and flow through the pipe substantially in accordance with a hydromechanic velocity distribution curve under the application of hydraulic pressure, thereby contacting the inner wall of the pipe to scrape off scale. When the small spheres reach a portion of the pipe having a larger or smaller diameter, the configuration of the group of these spheres changes in accordance with the velocity distribution curve conforming to the particular diameter, so that the small spheres stay in contact with the inner wall of the pipe as before in order to scrape off the scale. In other words, the group of small spheres undergoes motion in accordance with a velocity distribution curve that conforms to the pipe diameter, thus making it possible to clean the interior of a pipe having any diameter.

The pipe cleaning method of the present invention is advantageous in that the small spheres which contact the inner wall of the pipe do so in a mutually alternating manner as the spheres flow in accordance with the hydromechanic velocity distribution curve. As a result, the pin heads do not sustain partial wear.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
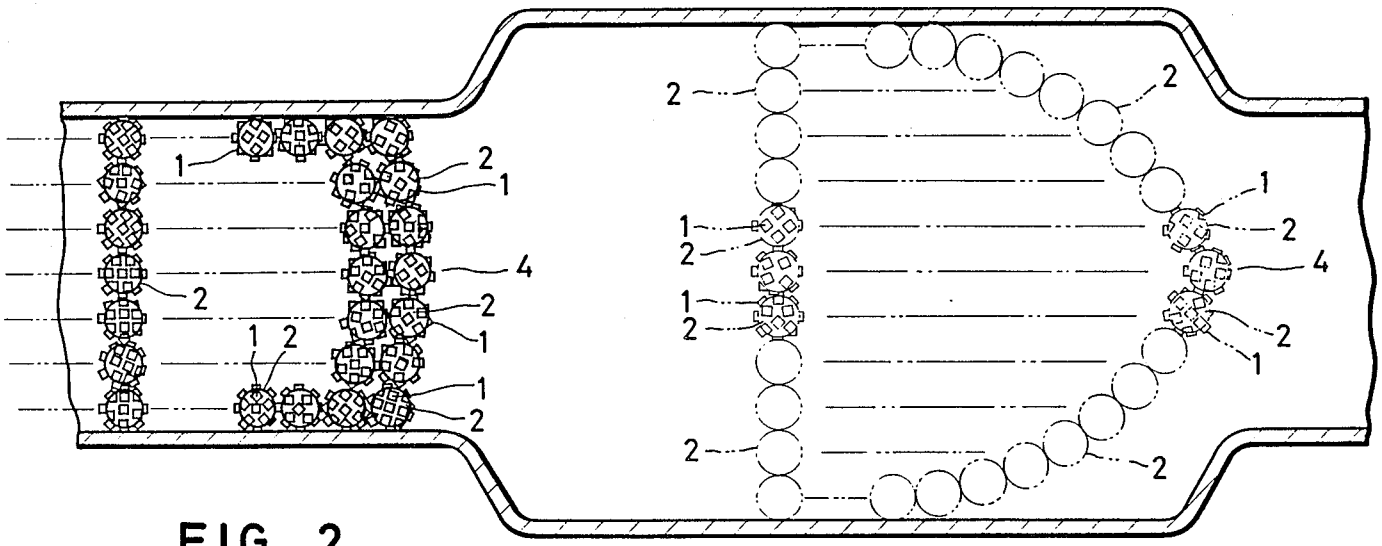
FIG. 1 is a sectional view illustrating a distribution of small spheres inside a pipe to be cleaned.
Figure 2:
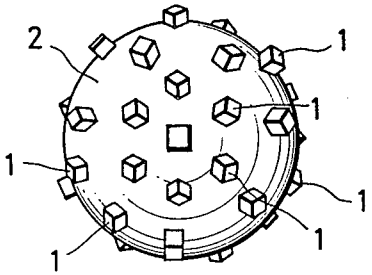
FIG. 2 is a view of small sphere.

As illustrated in the Figures, a multiplicity of small spheres 2 made of expanded styrol or styrofoam and having a number of spaced pins 1 driven therein are prepared. Each pin 1 has a generally rectangular head and is made of a material having a hardness of 900–1000 HB, the surface of the head being plated with chrome. The pins 1 are driven into the spheres 2 in such a manner that the heads of the pin are exposed. For example, each small sphere 2 has a diameter of 40 mm, each pin 1 has a square head whose sides are 4 mm in length, and the pins 1 are driven into the sphere 2 so as to be spaced apart from one another by 10 mm. It is preferred that the diameters of the spheres 2 be about one-tenth the smallest diameter of the pipe to be cleaned.

By way of example, a group of about 100 of these small spheres 2 is charged into an opening of a pipe 3 having diameters of 200 mm and 300 mm in part to be cleaned. Next, hydraulic pressure is applied to the group of spheres 2 from one side thereof according to a conventional method as used for a prior pig to feed the spheres 2 through the interior of the pipe 3. The group of spheres 2 will flow through the pipe in accordance with a hydromechanic velocity distribution curve 4 expressed by the equation $$\frac{V}{Vh} = 5.75 \log_{10} \frac{Y}{K} + 8.48$$

Where

V: average flow velocity

Vh: flow velocity at any point on the distribution curve

Y: diameter of the pipe

K: any point from the pipe wall

Accordingly, even if the diameter of the pipe 3 changes, the velocity distribution curve thereof also changes, so that the group of small spheres will flow as one mass without clogging the interior of the pipe 3 and without scattering within the pipe as the spheres scrape scale from the inner wall.

As many apparently widely different embodiments of the present invention can be made without departing from the spirit and scope thereof, it is to be understood that the invention is not limited to the specific embodiments thereof except as defined in the appended claims.

What is claimed is:

1. A method for cleaning the interior of a stationary pipe comprising introducing a plurality of small spheres as a group into one end of the interior of the pipe to be cleaned, each sphere having a diameter less than 1/10 of the diameter of the pipe to be cleaned and having a plurality of rectangular-shaped heads projecting from its surface and applying hydraulic pressure to the plurality of spheres from one side of the group thereof to propel them through the pipe as a single mass that adapts to any changes in the diameter of the pipe.

2. The method of claim 1, wherein the spheres are of styrofoam having a plurality of pins with square heads driven into their surface so that the heads of the pins are left exposed.

* * * * *